US010342272B2

(12) United States Patent
Hendrick

(10) Patent No.: US 10,342,272 B2
(45) Date of Patent: Jul. 9, 2019

(54) TWO PIECE MULTI-ACCESSORIZED WORK SUIT

(71) Applicant: Christopher Troy Hendrick, Los Angeles, CA (US)

(72) Inventor: Christopher Troy Hendrick, Los Angeles, CA (US)

( * ) Notice: Subject to any disclaimer, the term of this patent is extended or adjusted under 35 U.S.C. 154(b) by 213 days.

(21) Appl. No.: 15/627,602

(22) Filed: Jun. 20, 2017

(65) Prior Publication Data

US 2018/0360138 A1 Dec. 20, 2018

(51) Int. Cl.

| | |
|---|---|
| ***A41D 13/00*** | (2006.01) |
| ***A41D 13/02*** | (2006.01) |
| *A41D 3/00* | (2006.01) |
| *A41D 1/06* | (2006.01) |
| *A41D 13/01* | (2006.01) |
| *A41D 13/06* | (2006.01) |
| *A41D 13/08* | (2006.01) |
| *A41D 13/05* | (2006.01) |

(52) U.S. Cl.

CPC ..... *A41D 13/0012* (2013.01); *A41D 13/02* (2013.01); *A41D 1/06* (2013.01); *A41D 3/00* (2013.01); *A41D 13/01* (2013.01); *A41D 13/0512* (2013.01); *A41D 13/0531* (2013.01); *A41D 13/065* (2013.01); *A41D 13/08* (2013.01); *A41D 2600/20* (2013.01)

(58) Field of Classification Search

CPC ..... A41D 13/0012; A41D 1/002; A41D 1/06; A41D 3/00; A41D 13/02

See application file for complete search history.

(56) References Cited

U.S. PATENT DOCUMENTS

| | | | | |
|---|---|---|---|---|
| 4,608,716 | A * | 9/1986 | Brumfield | A41D 13/015 2/102 |
| 5,105,473 | A * | 4/1992 | Valtakari | A41D 13/015 2/22 |
| 5,729,832 | A * | 3/1998 | Grilliot | A41D 13/00 2/2.5 |
| 7,020,896 | B2 * | 4/2006 | Davis | A41D 13/015 2/69 |
| 7,296,301 | B1 * | 11/2007 | Conn | A41D 13/0562 2/23 |
| 8,932,965 | B1 * | 1/2015 | Wendel | C09B 9/00 442/59 |
| 9,161,575 | B1 * | 10/2015 | Kramer | A41D 1/067 |
| 9,364,034 | B2 * | 6/2016 | Best | A41D 13/0005 |
| 9,557,139 | B1 * | 1/2017 | Miner | F41C 33/0218 |
| 10,168,122 | B1 * | 1/2019 | Cash | F41C 33/048 |
| 2002/0040493 | A1 * | 4/2002 | Wooley | A41D 13/0012 2/102 |
| 2002/0113107 | A1 * | 8/2002 | Hartranft | A45F 5/00 224/683 |
| 2003/0000003 | A1 * | 1/2003 | Boersema | A41B 11/008 2/69 |
| 2003/0159194 | A1 * | 8/2003 | Frank | A41D 13/0012 2/102 |
| 2004/0143887 | A1 * | 7/2004 | Durkin | A41D 13/05 2/267 |

(Continued)

*Primary Examiner* — Richale L Quinn

(57) ABSTRACT

Described herein is a two-piece multi-accessorized work suit. The work suit includes a jacket portion and a pants portion. The jacket portion and the pants portion including a plurality of padded regions, reflective areas, and a plurality of pockets for the receipt of various tools and accessories.

7 Claims, 5 Drawing Sheets

(56) References Cited

U.S. PATENT DOCUMENTS

2004/0187183 A1* 9/2004 Hautala ..... A41D 13/0012 2/24
2004/0237169 A1* 12/2004 Wood ..... A41D 13/0012 2/94
2005/0015844 A1* 1/2005 Parsons ..... A41D 3/00 2/94
2005/0017034 A1* 1/2005 Ausanio ..... A41D 13/0012 224/230
2005/0022289 A1* 2/2005 Platt ..... A41D 13/0012 2/250
2005/0066424 A1* 3/2005 Salazar ..... A41D 1/06 2/227
2005/0188450 A1* 9/2005 Clark ..... A41D 13/0012 2/247
2006/0143774 A1* 7/2006 Walsh ..... A41D 13/0012 2/94
2006/0288466 A1* 12/2006 Bucheit ..... A41D 13/0012 2/102
2008/0216212 A1* 9/2008 Burgess ..... A41D 1/06 2/228
2008/0301863 A1* 12/2008 Goff ..... A41D 13/0012 2/467
2010/0088795 A1* 4/2010 Simione ..... A41D 1/088 2/24
2011/0072556 A1* 3/2011 Bang ..... A41D 27/08 2/227
2011/0083248 A1* 4/2011 Johson ..... A41D 13/0012 2/102
2011/0099682 A1* 5/2011 Earley ..... A41D 13/0012 2/115
2011/0119800 A1* 5/2011 Garrido ..... A41D 13/0012 2/2.15
2012/0030861 A1* 2/2012 Miller ..... A41D 1/08 2/221
2012/0117713 A1* 5/2012 Hoffner ..... A41D 27/20 2/227
2012/0131734 A1* 5/2012 Sindicich ..... A41D 13/0012 2/458
2013/0043286 A1* 2/2013 Kast ..... A45F 5/02 224/191
2013/0185840 A1* 7/2013 Grozdev ..... A41D 13/0012 2/69
2015/0089708 A1* 4/2015 Trevino ..... A41D 13/0012 2/69
2015/0359273 A1* 12/2015 Olson ..... A41B 9/001 2/250
2015/0359279 A1* 12/2015 Chang ..... A41D 27/201 2/252
2015/0359280 A1* 12/2015 Chang ..... A41D 27/201 2/249
2015/0374043 A1* 12/2015 Dahl ..... A41D 1/04 2/102
2016/0219943 A1* 8/2016 Hoiles ..... A41D 1/06
2016/0367021 A1* 12/2016 Moreau ..... A45F 3/00
2016/0374407 A1* 12/2016 Yagerman ..... A41D 13/0012 2/411
2017/0202275 A1* 7/2017 St. John ..... A41D 27/10
2018/0070658 A1* 3/2018 Rudick ..... A41F 9/025
2018/0160744 A1* 6/2018 Blauer ..... A41D 3/005
2018/0292167 A1* 10/2018 Rocque ..... F41C 33/048
2018/0360138 A1* 12/2018 Hendrick ..... A41D 13/0012

* cited by examiner

TWO PIECE MULTI-ACCESSORIZED WORK SUIT

FIELD OF THE INVENTION

The invention relates generally to a two-piece multi-accessorized work suit adapted for wearing by a user and including a plurality of fixtures to accommodate a multitude of tools and work accessories.

BACKGROUND

In a typical work task involving the utilization of tools individual are often required to carry all of the necessary tools and accessories to a jobsite to complete the given task or project. Typically, these accessories and tools are carried to the jobsite within a container such as a tool box or bag. Still further, these individuals are often required to wear specialized and durable workwear adapted for a given job or task. Usually, this work wear is comprised of jackets, shirts, and pants that are constructed out of robust and durable materials such as denim, canvas, and synthetic material blends. While this workwear is often useful to protect a user during a given task, it is not generally useful in carrying a variety and multitude of tools as the provided pockets and fastening elements are not generally useful for tool carrying.

Accordingly, in carrying and utilizing tools and accessories at a jobsite an individual will often utilize a tool belt or separate carrier adapted to be worn on the body of the user, wherein the user will transfer the necessary tools from the tool box or bag to the tool belt for immediate access to the tools during the given task while on the jobsite. A typical tool belt is worn around the waist of the user and supported on the hips and torso of the wearer, wherein a full tool belt can be quite heavy, cumbersome, and taxing on the user after a long day on the jobsite.

Therefore, there is a need within the marketplace for improved workwear that is specifically adapted for carrying tools and accessories. Preferably, this workwear is durable, robust, and adapted with safety and visibility improvements.

SUMMARY OF THE INVENTION

The work suit of the present invention is generally comprised of top portion consisting of a jacket and bottom portion consisting of pants. The jacket and pants work suit combination is adapted to provide a robust, durable, comfortable, and useful work suit specifically adapted for wearing by a user for the storage and transport of tools and related accessories.

The jacket portion of the work suit generally comprised of a garment adapted for wearing on the torso of a wearer and includes a pair of long sleeves adapted to extend from a shoulder region of a wearer to the a wrist of the wearer. The jacket portion includes a front side, a rear side, a left sleeve, and a right sleeve orientated according to the body regions of the wearer during use and wherein the front side is adapted for positioning at the front torso, chest, and abdominal regions of the wearers body, the rear side is adapted for positioning along the back of wearers body, the left sleeve is adapted for positioning on the left arm of the wearer, and the right sleeve adapted for positioning on the right arm of the wearer.

The jacket front side is comprised of a right side adjacent to the right sleeve and a left side adjacent to the left sleeve forming two halves of the front side and orientated according to a central sagittal plane, wherein the left side is aligned with the left front of the wearers body and the right side aligned with the right front of the wearers body. The left side and right side are selectively coupled together with a zipper, wherein the left side and right side can be secured together to close the jacket and uncoupled to open the jacket.

The jacket front side right side and left side forming mirror images of each other, wherein each side has a plurality of specifically designed and placed tool and accessory attachment areas in the form of pockets, loops, and straps.

The jacket rear side is generally aligned with the back of the wearer and adapted with a reflective materials to allow for visibility in low light situations. The rear side includes a sleeve for the placement of a padded member to protect the back of wearer from both impacts and to offer resting support when working in a lying position. The rear side further includes a collar portion with an integrated sleeve for the placement of a removable pad to offer additional support to the neck of the wearer.

The pants of the work suit are generally comprised of a garment adapted for wearing on the waist of a wearer and includes a pair of leg portions adapted to extend from the waist region of the wearer to an ankle of the wearer. The pant portion of the work suit includes a front side, a rear side, a left leg portion, and a right leg portion orientated according to the body regions of the wearer during use and wherein the front side is adapted for positioning at the front of the lower extremities of the wearers body, the rear side adapted for positioning at a rear of the lower extremities of the wearers body, the left leg portion adapted for positioning on the left leg of the wearer, and the right leg adapted for positioning on the right leg of the wearer.

The pants of the work suit are constructed with a fly portion aligned centrally between the left side and the right side orientated according to a central sagittal plane, wherein the left side is aligned with the left front of the wearer's body and the right side aligned with the right front of the wearer's body. The left side and right side forming mirror images of each other, wherein each side has a plurality of specifically designed and placed tool and accessory attachment areas in the form of pockets, loops, and straps.

The pants further included padded regions in form of sleeves and removable pads aligned with the knees of the wearer and wherein the padded regions provide both protective and resting support to the knees of a wearer. Additionally, the pants further include reflective embellishments to aid in the visibility of the wearer during use in low light conditions.

The materials of the work suit are generally made from a hybrid breathable material for added comfort and comprised of different types of material to aid in the various climate differences depending on the geological location and climate and weather changes, wherein the material is comprised of fibers of various types, including, but not limited to, cotton, rayon, polyester blended, khaki, and other high quality very durable and sturdy fabric and materials.

Various regions of the work suit include additional and removable padded members adapted for placement to protect the corresponding body regions, including, but not limited to, elbows, knees, shoulders, neck, and back.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
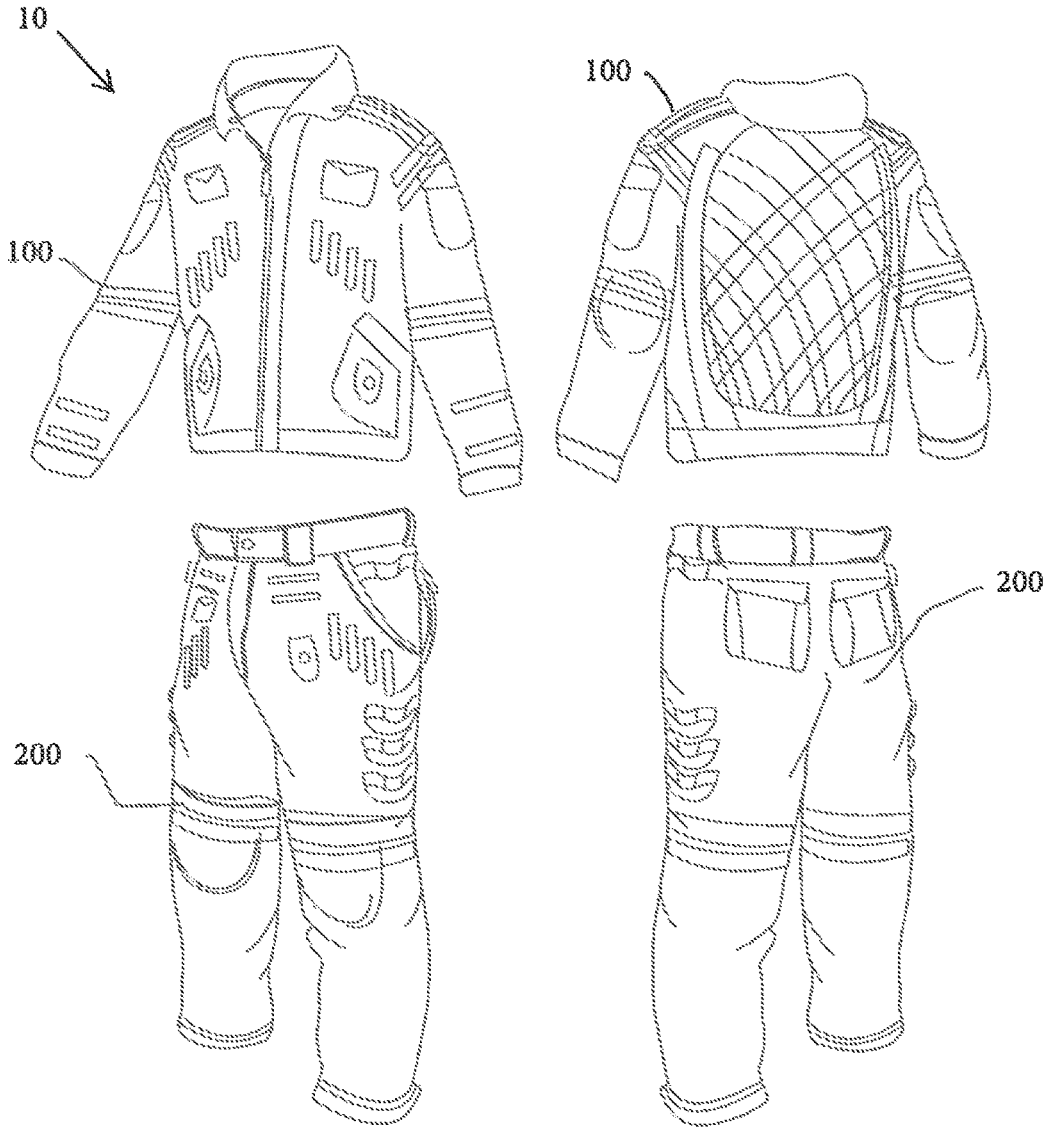
FIG. 1 shows an isometric view of the front side and rear side of the jacket and pants of the work suit, according to the present invention.

The following detailed description includes references to the accompanying drawing, which forms a part of the detailed description. The drawing shows, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Figure 2:
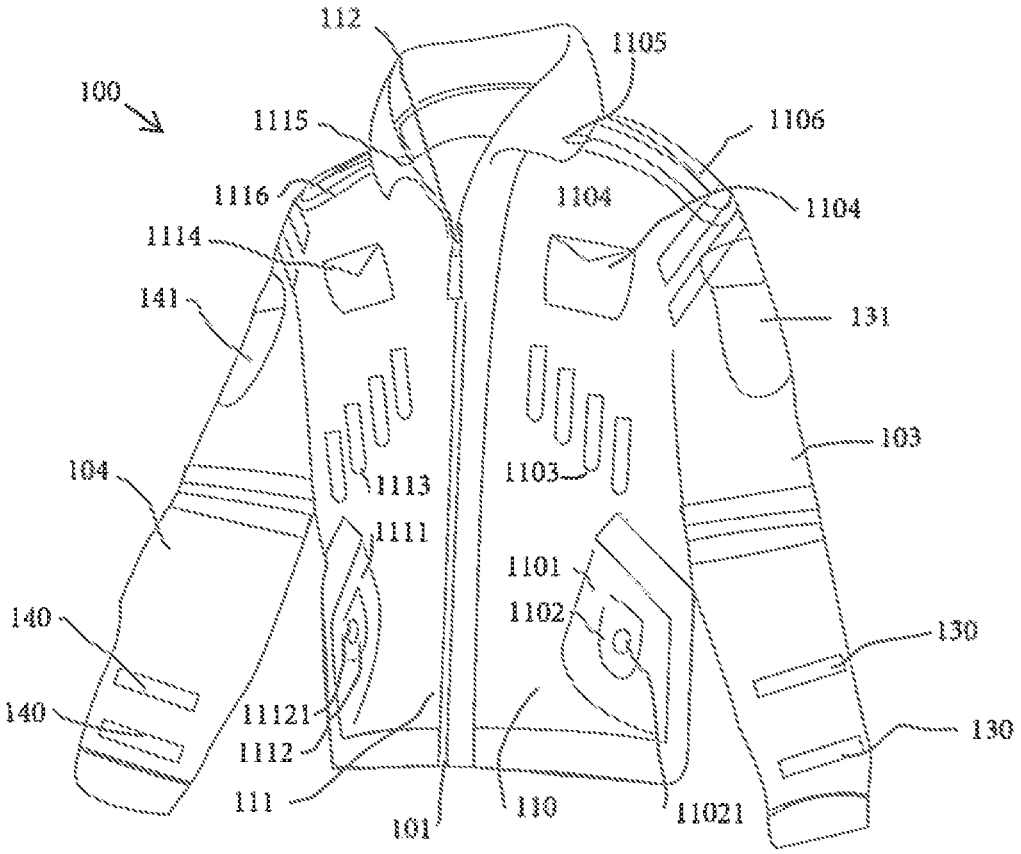
FIG. 2 shows an isometric view of the front side of the jacket of the work suit, according to the present invention.
Figure 3:
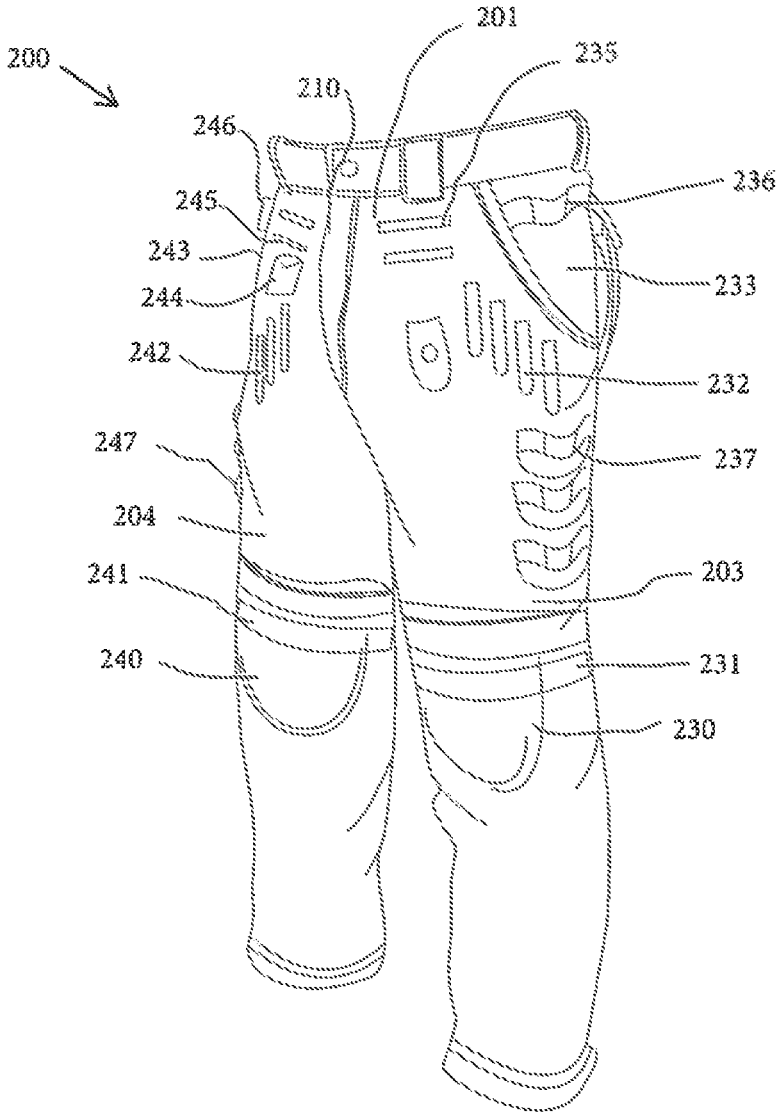
FIG. 3 shows an isometric view of the front side of the pants of the work suit, according to the present invention.
Figure 4:
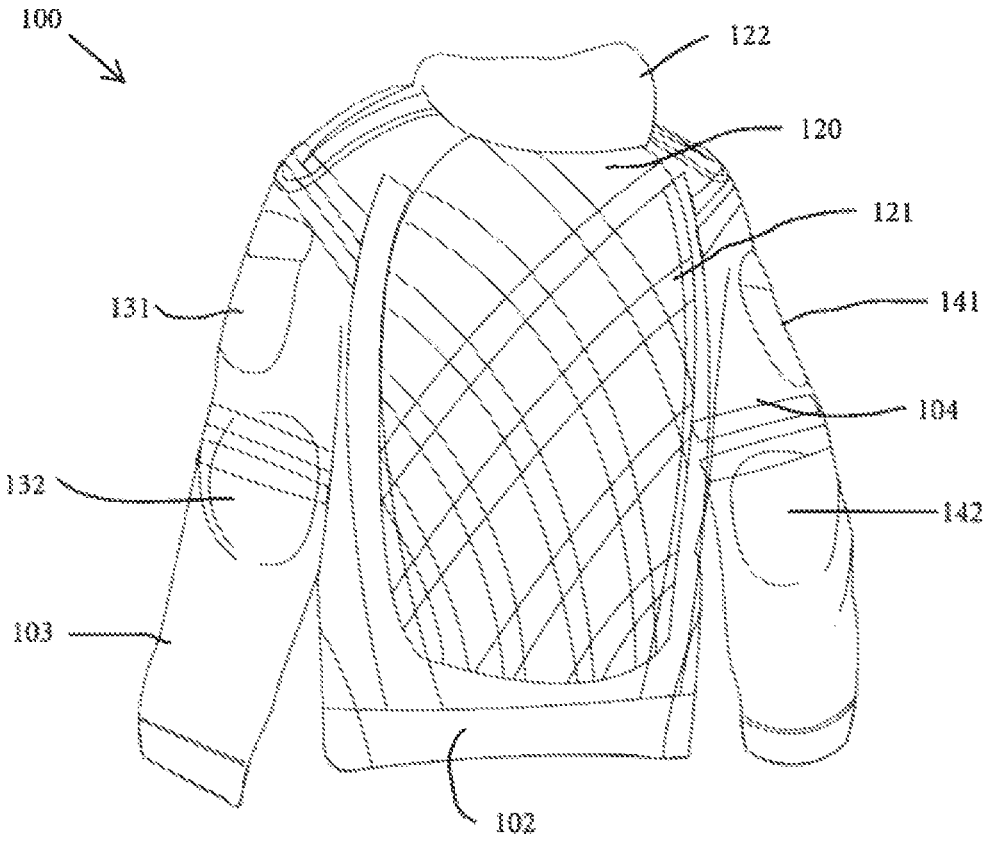
FIG. 4 shows an isometric view of the rear of the jacket of the work suit, according to the present invention.
Figure 5:
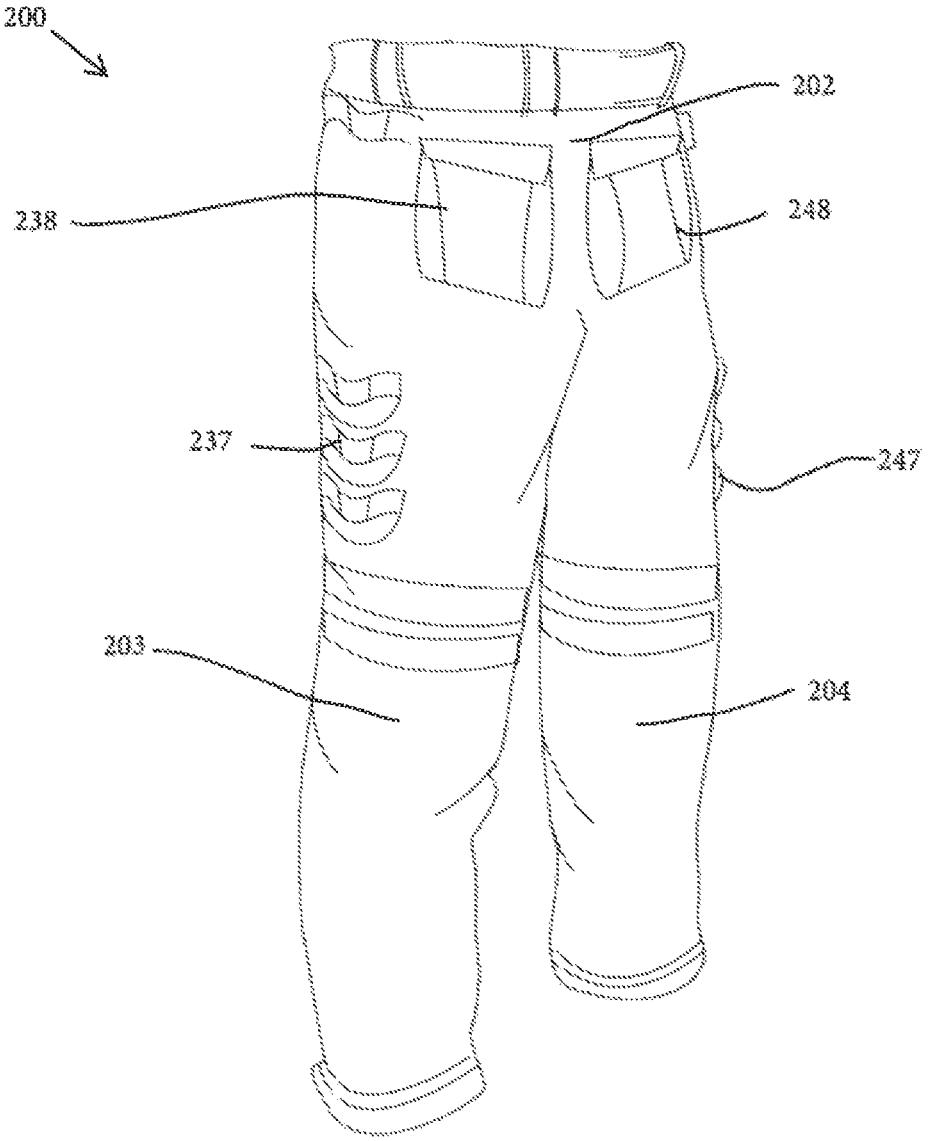
FIG. 5 shows an isometric view of the rear of the pants of the work suit, according to the present invention.

Referring to the figures, FIG. 1-5 show the work suit generally designated as suit 10. The suit 10 is generally composed of a jacket portion 100 and pants portion 200. The jacket 100 and pants 200 are intended to function as a depository for multiple tools and devices needed in the task of any job. Therefore, the jacket 100 and pants 200 include a plurality of pockets, loops, attachment mechanisms, hook and loop fasteners, binders, clips, and other securing and retaining means. The jacket 100 and pants 200 are further designed to provide protection to a wearer and therefore include several padded members and pockets and seams for the placement of these padded members.

The jacket portion 100 of the work suit 10 comprising a garment adapted for wearing on the torso of a wearer and includes a pair of long sleeves adapted to extend from a shoulder region of a wearer to the a wrist of the wearer. The jacket portion 100 includes a front side 101, a rear side 102, a left sleeve 103, and a right sleeve 104 orientated according to the body regions of the wearer during use and wherein the front side 101 is adapted for positioning at the front torso, chest, and abdominal regions of the wearers body, the rear side 102 is adapted for positioning along the back of wearers body, the left sleeve 103 is adapted for positioning on the left arm of the wearer, and the right sleeve 104 adapted for positioning on the right arm of the wearer.

The jacket front side 101 is comprised of a right side 111 adjacent to the right sleeve 104 and a left side 110 adjacent to the left sleeve 103 forming two halves of the front side 101 and orientated according to a central sagittal plane, wherein the left side 110 is aligned with the left front of the wearers body and the right side 111 aligned with the right front of the wearers body. The left side 110 and right side 111 are selectively coupled together with a zipper 112, wherein the left side 110 and right side 111 can be secured together to close the jacket 100 and uncoupled to open the jacket 100.

The jacket 100 front side 101 right side 111 and left side 110 and corresponding sleeves 103, 104 forming mirror images of each other, wherein each side has a plurality of similarly placed and specifically designed tool and accessory attachment areas in the form of pockets, loops, and straps. Accordingly, the left sleeve 103 and the right sleeve 104 having at least two drill bit holders 130, 140 positioned adjacent a wrist portion of the corresponding sleeve 103, 104 opposite and distal a shoulder region of the jacket 100. The drill bit holders 130, 140 generally formed from a strap sewn onto the sleeve in a cup-like fashion sized and shaped to retain a standard sized drill bit tip.

The left sleeve 103 and the right sleeve 104 include a sleeve utility pocket 131, 141 positioned on an upper portion of the sleeve 103, 104 opposite the wrist portion and approximately aligned with the shoulder body region of the wearer. The sleeve utility pocket 131, 141 generally designed as a pocket to secure various smaller sized items including, but not limited to, stud finders, multi meters, cell phones, and other items of a similar size and shape.

The left sleeve 103 and the right sleeve 104 further include elbow pads 132, 142 adapted for positioning adjacent to the left and right elbows of the wearer during use. The elbow pads 132, 142 are generally comprised of a sleeve portion adapted to receive a padded member wherein the elbow pads 132, 142 can be easily removed. Preferably, the sleeve portion of the elbow pads 132, 142 is secured through a hook and loop type fastener.

The jacket front side 101 left side 110 and right side 111 including a number of pockets for various items including a main utility pocket 1101, 1111, a tape roll pocket 1102, 1112, a plurality of single tool pockets 1103, 1113, and a chest utility pocket 1104, 1114. The main utility pocket 1101, 1111 is positioned near a lower portion of the jacket front side 101 and generally positioned corresponding to a standard jacket pocket adapted to receive the hands of the user. The main utility pocket 1101, 1111 may be lined with a padded foam material to protect the wearer from potential puncture from items placed within the interior. Accordingly, the main utility pocket 1101, 1111 may be utilized to store and secure sharp objects such as nails and screws.

The tape roll pocket 1102, 1112 is positioned on an exterior of the main utility pocket 1101, 1111 and generally adapted to secure a roll of tape. Accordingly, the tape roll pocket 1102, 1112 is designed with an arcuate bottom and a central aperture 11021, 11121 generally aligned with a center portion of a tape roll, allowing a user to easily insert a finger into the central aperture 11021, 11121 to remove an embedded roll of tape within the tape roll pocket 1102, 1112.

The plurality of single tool pockets 1103, 1113 are generally positioned above the main utility pocket 1101, 1111 and comprised of a stretchable elastic or elastic-like material to allow for the placement of single tool, such as, but not limited to, screw drivers, pliers, needle-nose pliers, or other similar hand-held tools.

The chest utility pocket 1104, 1114 is generally positioned above the plurality of single tool pockets 1103, 1113 and adapted generally for positioning on the corresponding left chest and right chest area of the wearer. The chest utility pocket 1104, 1114 is preferably comprised of an elastic or elastic-like material and adapted to secure smaller objects, such as but not limited to, small electrical multi-meters, cellular telephones, and other similarly sized miscellaneous items.

The left and right collar portions of the jacket 100 include a pair of detachable flashlights 1105, 1115. Preferably the flashlights, 1105, 1115 are comprised of a light emitting diode (LED) as the light source for increased longevity and durability.

The left and right shoulder regions of the jacket 100 include a pair of removable shoulder pads 1106, 1116 to provide removable protection to the shoulder region of the wearer during use.

The jacket 100 rear side 102 is generally aligned with the back of the wearer and adapted with a reflective materials 121 to allow for visibility in low light situations. The rear side 102 includes a sleeve 120 for the placement of a padded member to protect the back of wearer from both impacts and to offer resting support when working in a lying position. The rear side 102 further includes a collar portion 122 with an integrated sleeve for the placement of a removable pad to offer additional support to the neck of the wearer.

The pants 200 of the work suit 10 are generally comprised of a garment adapted for wearing on the waist of a wearer and include a pair of leg portions adapted to extend from the waist region of the wearer to an ankle of the wearer. The pant portion 200 of the work suit 10 includes a front side 201, a rear side 202, a left leg portion 203, and a right leg portion 203 orientated according to the body regions of the wearer during use and wherein the front side 201 is adapted for positioning at the front of the lower extremities of the wearers body, the rear side 202 adapted for positioning at a rear of the lower extremities of the wearers body, the left leg portion 203 adapted for positioning on the left leg of the wearer, and the right leg portion 204 adapted for positioning on the right leg of the wearer.

The pants 200 of the work suit are constructed with a fly portion 210 aligned centrally between the left leg portion 203 and the right leg portion 204 orientated according to a central sagittal plane, wherein the left leg portion 203 is aligned with the left front leg of the wearers body and the right leg portion 204 aligned with the right front leg of the wearers body. The left leg portion 203 and right leg portion 204 forming mirror images of each other, wherein each leg portion 203, 204 has a plurality of specifically designed and placed tool and accessory attachment areas in the form of pockets, loops, and straps.

The pants front side 201 left leg portion 203 and right leg portion 204 including a number of pockets for various items including a plurality of single tool pockets 232, 242, main pants utility pocket 233, 243, a tape roll pocket 234, a small utility pocket 244, drill bit holders 235, 245, holsters 236, 246, and hammer loops 237, 247. The main pants utility pocket 233, 243 is positioned near an upper portion of the pants 200 adjacent to the waist of the wearer and generally positioned corresponding to a standard pants. Adjacent to the main pants utility pocket 233, 243 is holster 236, 246 adapted to receive a cordless drill. Accordingly, the holster 236, 246 is preferably constructed out of an elastic material to allow the holster 236, 246 to stretch and secure an embedded tool or drill.

The plurality of single tool pockets 232, 242 are generally positioned on an exterior portion of the pants utility pocket 233, 243 and comprised of a stretchable elastic or elastic-like material to allow for the placement of single tool, such as, but not limited to, screw drivers, pliers, needle-nose pliers, or other similar hand-held tools.

The tape roll pocket 234 is positioned central to the plurality of single tool pockets 233 positioned on the left leg portion 203 of the pants 200. The tape roll pocket 234 is generally adapted to secure a roll of tape. Accordingly, the tape roll pocket 234 is designed with an arcuate bottom and a central aperture 2340 generally aligned with a center portion of a tape roll, allowing a user to easily insert a finger into the central aperture 2340 to remove an embedded roll of tape within the tape roll pocket 234.

The small utility pocket 244 is generally positioned above the plurality of single tool pockets 242 on the right side 204 of the pants 200 and is preferably comprised of an elastic or elastic-like material and adapted to secure smaller objects, such as but not limited to, small electrical multi-meters, cellular telephones, and other similarly sized miscellaneous items.

The drill bit holders 235, 245 are positioned central to the utility pocket 233, 243 and generally formed to secure a drill bit. Accordingly, the drill bit holders 235, 245 are generally cup-like in shape with an open top portion and enclosed bottom portion to secure a drill bit. Preferably, the bit holders 235, 245 are comprised of an elastic material to provide additional securing and flexibility.

The hammer loops 237, 247 are positioned along the side of the pants distal the fly 210 and generally formed to secure the handle of a hammer. In the preferred embodiment the hammer loops 237, 247 are each comprised of at least three distinct loops with the bottom loop enclosed to prevent swinging of the handle of the hammer-like tool engaged within the loops 237, 247.

The rear portion 202 of the pants 200 includes a rear utility pocket 238, 248 generally adapted and placed in a standard location corresponding to traditional rear pants pockets.

The pants 200 further include padded regions in form of sleeves and removable pads aligned with the knees of the wearer forming knee pads 230, 240 and wherein the padded regions provide both protective and resting support to the knees of a wearer. Additionally, the pants 200 further include reflective embellishments 231, 241 to aid in the visibility of the wearer during use in low light conditions.

The pants 200 are generally provided with belt loops at the waist region sized and shaped to correspondingly receive a belt if the wearer chooses.

The materials of the work suit are generally made from a hybrid breathable material for added comfort and comprised of different types of material to aid in the various climate differences depending on the geological location and climate and weather changes, wherein the material is comprised of fibers of various types, including, but not limited to, cotton, rayon, polyester blended, khaki, and other high quality very durable and sturdy fabric and materials.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the an relying upon the disclosure in this specification and the attached drawings.

The invention claimed is:

1. A two-piece work suit adapted for wearing by a wearer, the work suit comprising:

a jacket portion, the jacket portion adapted for wearing around a torso of a wearer, the jacket portion having:

a left sleeve, the left sleeve aligned with the left arm of the wearer and adapted to extend from the left shoulder of the wearer to the left wrist of the wearer, the left sleeve having a plurality of drill bit holders, the drill bit holders adapted to receive and secure a drill bit, the left sleeve including a removable elbow pad, the elbow pad positioned adjacent to the left elbow of the wearer, the elbow pad adapted to cushion the left elbow of the wearer;

a right sleeve aligned with the right arm of the wearer and adapted to extend from the right shoulder of the wearer to the right wrist of the wearer, the right sleeve having a plurality of drill bit holders, the drill bit holders adapted to receive and secure a drill bit, the right sleeve including a removable elbow pad, the elbow pad positioned adjacent to the right elbow of the wearer, the elbow pad adapted to cushion the right elbow of the wearer;

a front portion, the front portion aligned with the front torso area of the wearer, the front portion including a plurality of pockets, the pockets adapted to contain and secure various objects; and a back portion, the back aligned with the back of the wearer, the back portion including removable pad, the removable pad adapted for placement adjacent the back of the wearer and designed to provide cushioned and protective support to the wearer;

a pants portion, the pants portion adapted for placement on the lower extremities of the wearer from the waist region to the ankles of the wearer, the pants portion having:

a left leg portion, the left leg portion aligned with the left leg of the wearer and adapted to extend from the left hip of the wearer to the left ankle of the wearer, the left leg portion having a plurality of single tool pockets, the single tool pockets adapted to receive and secure a tool, the left leg portion including a removable knee pad, the removable knee pad positioned adjacent to the left knee of the wearer, the knee pad adapted to cushion the left knee of the wearer; and a right leg portion aligned with the right leg of the wearer and adapted to extend from the right hip of the wearer to the right ankle of the wearer, the right leg portion having a plurality of single tool holders, the single tool holders adapted to receive and secure a tool, the right leg portion including a removable knee pad, the knee pad positioned adjacent to the right knee of the wearer, the knee pad the adapted to cushion the right knee of the wearer; and a plurality of reflective members, the reflective members positioned on both the jacket portion and the pants portion, the reflective members improving the visibility of the wearer, wherein the jacket portion front side includes at least one tape roll pocket, the tape roll pocket adapted to store a roll of tape, the tape roll pocket having a arcuate bottom portion and a central aperture, the central aperture aligned with the center hole of the roll of tape placed within an interior of the tape roll pocket.

2. A two-piece work suit as in claim 1, wherein the pants portion includes at least one tape roll pocket, the tape roll pocket adapted to store a roll of tape, the tape roll pocket having a arcuate bottom portion and a central aperture, the central aperture aligned with the center hole of the roll of tape placed within an interior of the tape roll pocket.

3. A two-piece work suit as in claim 1, wherein the jacket portion front side includes a pair of main utility pockets, the main utility pockets having an interior portion for the storage of items, the interior portion comprised of a padded material, the padded material offering protection to a wearer from sharp items placed within the interior portion of the main utility pockets.

4. A two piece work suit as in claim 3, wherein the pants portion includes at least three hammer loops positioned on the left leg portion and the right leg portion, the at least three hammer loops sized and shaped to receive a handle portion of a hammer.

5. A two piece work suit as in claim 1, wherein the jacket portion includes a collar, the collar aligned on an upper portion of the jacket portion adjacent to the neck of the wearer, the collar portion including an illumination means, the illumination means removable.

6. A two piece work suit as in claim 5, wherein the illumination means is a light emitting diode (LED).

7. A two piece work suit as in claim 6, wherein the color portion includes a removable pad, the removable pad adapted to provide protection to the neck area of the wearer.

* * * * *